US005197422A

United States Patent [19]

Oleksy et al.

[11] Patent Number: 5,197,422

[45] Date of Patent: Mar. 30, 1993

[54] COMPRESSION RELEASE MECHANISM AND METHOD FOR ASSEMBLING SAME

[75] Inventors: Paul D. Oleksy, Shorewood; Gene V. Fliss, Colgate, both of Wis.

[73] Assignee: Briggs & Stratton Corporation, Wauwatosa, Wis.

[21] Appl. No.: 854,582

[22] Filed: Mar. 19, 1992

[51] Int. Cl.[5] ..... F01L 13/08

[52] U.S. Cl. ..... 123/182.1; 29/888.1

[58] Field of Search ..... 123/182.1; 29/888.1

[56] References Cited

U.S. PATENT DOCUMENTS

| | | | |
|---|---|---|---|
| B 558,251 | 1/1976 | Harkness | 123/182.1 |
| 3,362,390 | 1/1968 | Esty | 123/182.1 |
| 3,381,676 | 5/1968 | Campen | 123/182.1 |
| 3,496,922 | 2/1970 | Campen | 123/182.1 |
| 3,511,219 | 5/1970 | Esty | 123/182.1 |
| 3,897,768 | 8/1975 | Thiel | 123/182.1 |
| 4,453,507 | 6/1984 | Braun et al. | 123/182.1 |
| 4,651,687 | 3/1987 | Yamashita et al. | 123/182.1 |
| 4,672,930 | 6/1987 | Sumi | 123/182.1 |
| 4,696,266 | 9/1987 | Harada | 123/182.1 |
| 4,892,068 | 1/1990 | Coughlin | 123/182.1 |
| 4,898,133 | 2/1990 | Bader | 123/182.1 |
| 4,977,868 | 12/1990 | Holschuh | 123/182.1 |

FOREIGN PATENT DOCUMENTS 362775A 4/1990 United Kingdom .

OTHER PUBLICATIONS

"EH Overhead Valve Engines . . . Robin" by Fuji Heavy Industries Ltd. issue EMD-EH0667 (1990.04).

*Primary Examiner*—Andrew M. Dolinar

*Attorney, Agent, or Firm*—Andrus, Sceales, Starke & Sawall

[57] ABSTRACT

The compression release mechanism for an internal combustion engine is inexpensive, easy to manufacture and assemble, and does not use any welds, pins or other fasteners to keep the components together. The compression release mechanism includes a flyweight having an aperture therein, a bushing having a sleeve portion that fits in the flywheel aperture and having a flange portion, and a lightweight torsion spring having at least several turns that is captured between the flywheel and the bushing flange. The compression release shaft that fits within the sleeve has a knurled outer surface to provide an interference fit with the deformable nylon bushing. The flywheel aperture, the sleeve portion, and the knurled section of the compression release shaft are preferably all D-shaped to provide positive positioning without the need for welds, pins and fasteners. The entire force of the valve tappet is borne by a D-shaped end of the compression release shaft so that a cam shaft surface need not be machined to support the compression release shaft. The opposite end of the release shaft is disposed within a cam gear aperture having a very close tolerance with the compression release shaft.

29 Claims, 4 Drawing Sheets 32b
32a
32
34
34b
32c
32d
34a
28a
28
28b
20
28
34a
32a
20a
34b
10
20
26c
32a
34a
20a
34b
10
16
28

FIG. 6
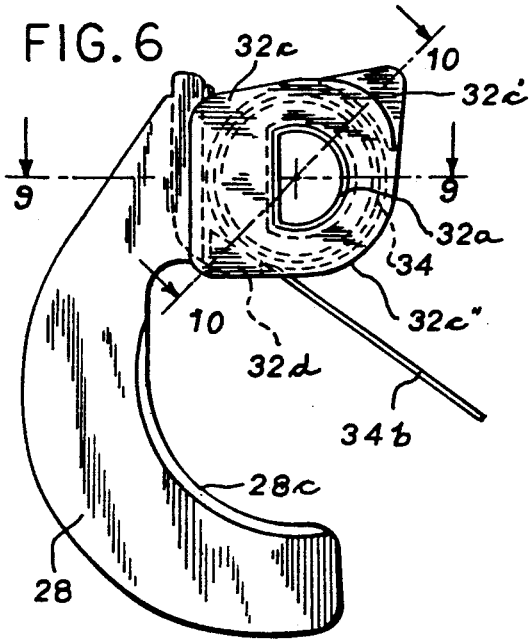
FIG. 7
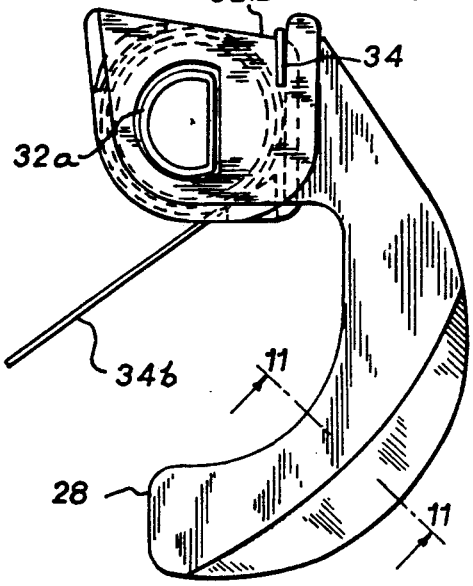
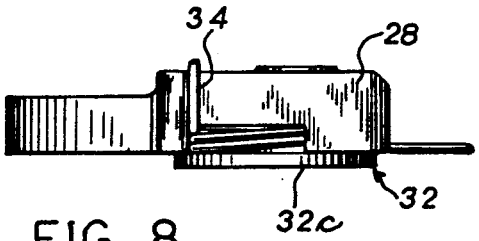
FIG. 8
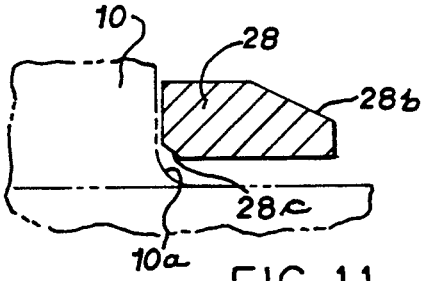
FIG. 11
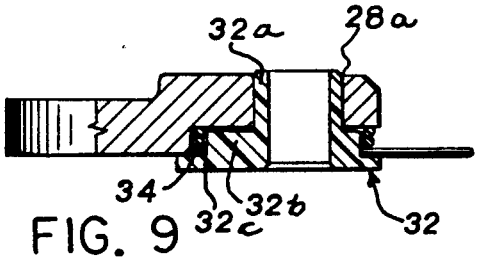
FIG. 9
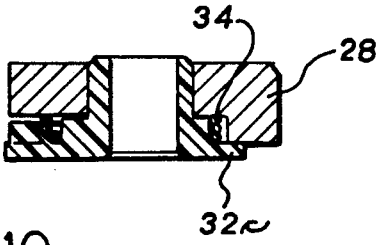
FIG. 10
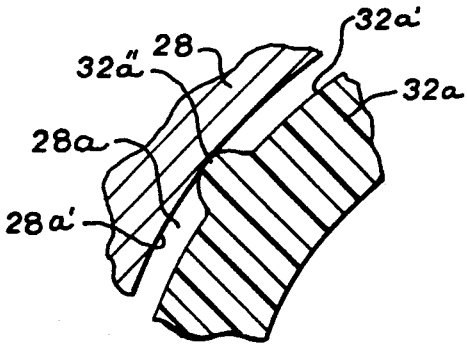
FIG. 12

COMPRESSION RELEASE MECHANISM AND METHOD FOR ASSEMBLING SAME

BACKGROUND OF THE INVENTION

This invention relates to compression release mechanisms for internal combustion engines.

It is often desirable to relieve the pressure in an engine combustion chamber during starting. By relieving this pressure, it is much easier for the piston to reciprocate in the engine when the operator manually pulls the starter rope. A compression release mechanism thus lessens the pull force required to start the engine, and minimizes operator fatigue during starting.

Several types of compression release mechanisms are known for internal combustion engines. A typical compression release mechanism is disclosed in U.S. Pat. No. 3,381,676 issued May 7, 1968 to Campen. The Campen compression release mechanism includes a centrifugally-responsive flyweight, a torsion spring attached to the flyweight, and a central pin which engages a valve tappet at engine starting speeds. At higher engine speeds, the flyweight moves radially outward so that the pin disengages the valve tappet when the engine is running.

The Campen compression release mechanism has several disadvantages. First, it requires major modifications to the cam shaft to include a central pin member therein. Also, the shaft about which the flyweight rotates must be fastened to the flyweight, resulting in additional complexity and expense.

Other compression release mechanisms overcome some of the problems in the '676 Campen patent. For example, U.S. Pat. No. 3,496,922 issued Feb. 24, 1970 to Campen discloses a centrifugally-responsive flyweight having a torsion spring attached thereto, and a compression release shaft interconnected with the flyweight. The compression release shaft has a D-shaped end that engages a valve tappet. However, the compression release shaft must still be connected to the flyweight using a pin or other fastener, thereby increasing the complexity and difficulty in manufacture.

U.S. Pat. No. 3,362,390 issued Jan. 9, 1968 to Esty is another centrifugally-responsive compression release mechanism using a compression release shaft having a D-shaped end. However, the Esty patent requires fasteners to retain the torsion spring, again increasing the complexity and expense of the device.

SUMMARY OF THE INVENTION

An improved compression release assembly is disclosed that does not require pins, fasteners or welds to hold the components together. Without such pins, fasteners or welds, the complexity and number of component parts are reduced, and expensive manufacturing and assembly steps are avoided. The compression release assembly eases starting of both electrically and manually started engines.

In its broadest form, the compression release mechanism according to the present invention includes a compression release shaft, a centrifugally-responsive flyweight having a flyweight aperture therein that receives a portion of the compression release shaft, a spring that is interconnected with either the shaft or with the flyweight, and a spring retainer that is both received within the flyweight aperture and that has a flange for retaining the spring. The flyweight aperture is disposed in a flyweight retainer portion of the flyweight.

In a preferred embodiment, the spring retainer is a bushing having a first sleeve portion that fits within the flyweight aperture and that receives a section of the compression release shaft therein. The bushing has a second portion, which may consist of a substantially flat flange, that captures and retains the spring in the flyweight-release shaft-bushing subassembly. In a preferred embodiment, the flyweight aperture, the sleeve portion of the bushing, and the section of the compression release shaft received in the bushing are substantially D-shaped to provide positive positioning without the need for alignment or fasteners. The release shaft may have a knurled outer surface section that engages and deforms the sleeve portion of the bushing during a press-fitting assembly step. Also, the outer surface of the bushing sleeve may have a plurality of protrusions or nibs which insure a tight fit with the flyweight during a press-fitting step.

The compression release shaft has one end that is received in and supported by a bearing surface in the cam gear. The opposite end of the release shaft is substantially D-shaped for engaging the valve tappet or other cam follower. The compression release shaft is supported by this bearing surface; the release shaft is not supported by the cam shaft, thereby avoiding the need to machine a surface on the cam shaft to support the compression release shaft.

The torsion spring used in the present invention preferably has two or more turns of a very thin wire to save on space. One end of the spring is preferably bent over the flyweight, with the opposite end portion being captured in a step in the bushing flange to enable this spring end portion to be placed against the cam shaft during assembly without manual retention of the spring end portion.

The present invention also includes a unique, greatly simplified method of assembling a compression release mechanism. According to this method, a torsion spring is attached to the flyweight, and a sleeve portion of a plastic bushing is inserted into an aperture in the flyweight. The bushing also retains the spring between the flange portion of the bushing and the flyweight. The flyweight aperture containing the sleeve portion is then aligned with a first side of an aperture in the cam gear. The compression release shaft is then inserted through the opposite side of the cam gear aperture and into the sleeve portion of the bushing. The compression release shaft is locked inside the sleeve portion by press-fitting a knurled section of the shaft inside the deformable sleeve. The sleeve has a plurality of protrusions extending from its outer surface which engage the flyweight when the sleeve is press-fit into the flyweight aperture.

It is a feature and advantage of the present invention to eliminate the use of pins, fasteners and welds in a compression release mechanism.

It is yet another feature and advantage of the present invention to provide a compression release mechanism which is inexpensive and easy to assemble.

These and other features and advantages of the present invention will be apparent to those skilled in the art from the following detailed description of the preferred embodiment and from the attached drawings, in which:

BRIEF DESCRIPTION OF THE DRAWINGS

FIG. 6 is an end view of the flyweight-spring-bushing subassembly.

FIG. 7 is an opposite end view of the subassembly of FIG. 6.

FIG. 8 is a top view of the subassembly depicted in FIG. 6.

FIG. 9 is a top view of the subassembly, taken along line 9—9 of FIG. 6.

FIG. 10 is a cross-sectional view of the subassembly, taken along line 10—10 of FIG. 6.

FIG. 11 is a cross-sectional view of the flyweight-cam shaft interface, taken along line 11—11 of FIG. 7.

FIG. 12 is a cross-sectional view of the flyweight aperture-bushing interface.

FIGS. 13*a* through 14*b* depict the steps in assembling the compression release mechanism to the cam shaft.

FIG. 13*a* is a side view of an assembly step wherein the flyweight-spring-bushing subassembly is placed into position.

FIG. 14*b* is an end view of the assembly step depicted in FIG. 14*a*.

DETAILED DESCRIPTION OF THE PREFERRED EMBODIMENT

Figure 1:
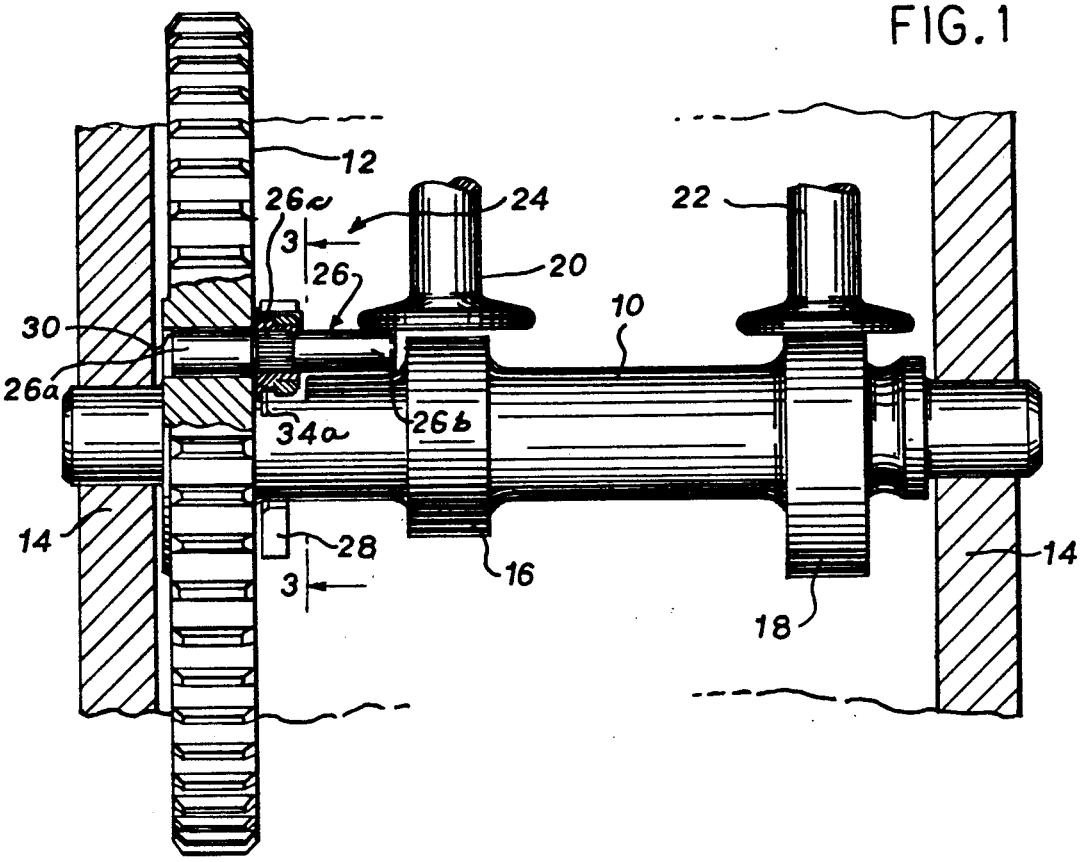
FIG. 1 is a side view of the compression release-cam shaft assembly according to the present invention, shown in partial section.

FIG. 1 is a side view of the compression release-cam shaft assembly according to the present invention. In FIG. 1, a rotatable cam shaft 10 has a cam gear 12 interconnected therewith. Cam shaft 10 is disposed in an engine housing 14. Cam gear 12 is driven by a timing gear (not shown) connected to a crankshaft (not shown) as is well-known in the art. Cam shaft 10 has at least two cam lobes 16 and 18 disposed thereon which operate a valve operating means that includes valve tappets 20 and 22. The movements of tappets 20 and 22 in response to cam lobes 16 and 18 respectively cause the intake and exhaust valves in an engine combustion chamber (not shown) to open in a predetermined manner as is well-known in the art.

To relieve compression in a combustion chamber during engine starting, compression release mechanism 24 lifts tappet 20 a sufficient distance to cause its associated valve to open. FIG. 1 depicts compression release mechanism 24 in its engaged position at engine starting speeds wherein tappet 20 is raised by compression release shaft 26. At engine running speeds, a centrifugally-responsive flyweight 28 moves radially outward away from cam shaft 10, causing release shaft 26 to rotate, as described below in connection with FIGS. 3 and 4.

Compression release shaft 26 is disposed within an aperture 30 in cam gear 12. Aperture 30 and end 26*a* of compression release shaft 26 have a very close tolerance compared with prior art devices to enable the forces imposed by tappet 20 to be totally borne by shaft 26. Aperture 30 preferably has a diameter of 0.25175 inches ±0.00075 inches. Shaft end 26*a* preferably has a diameter of 0.25 inches ±0.0005 inches. Shaft 26 is hardened by heating to about 1600° F. for one hour, and then tempering at 300° F. for one hour. A protective coating may also be placed on shaft 26.

To enable all the tappet forces to be borne by shaft 26, it is preferred that the distance between cam gear 12 and cam lobe 16 be relatively small, that shaft 26 be made from a hardened cold drawn carbon steel rod, and that the bearing surface between cam gear 12 and shaft end 26*a* be very tight.

Figures 3, 4, 5:
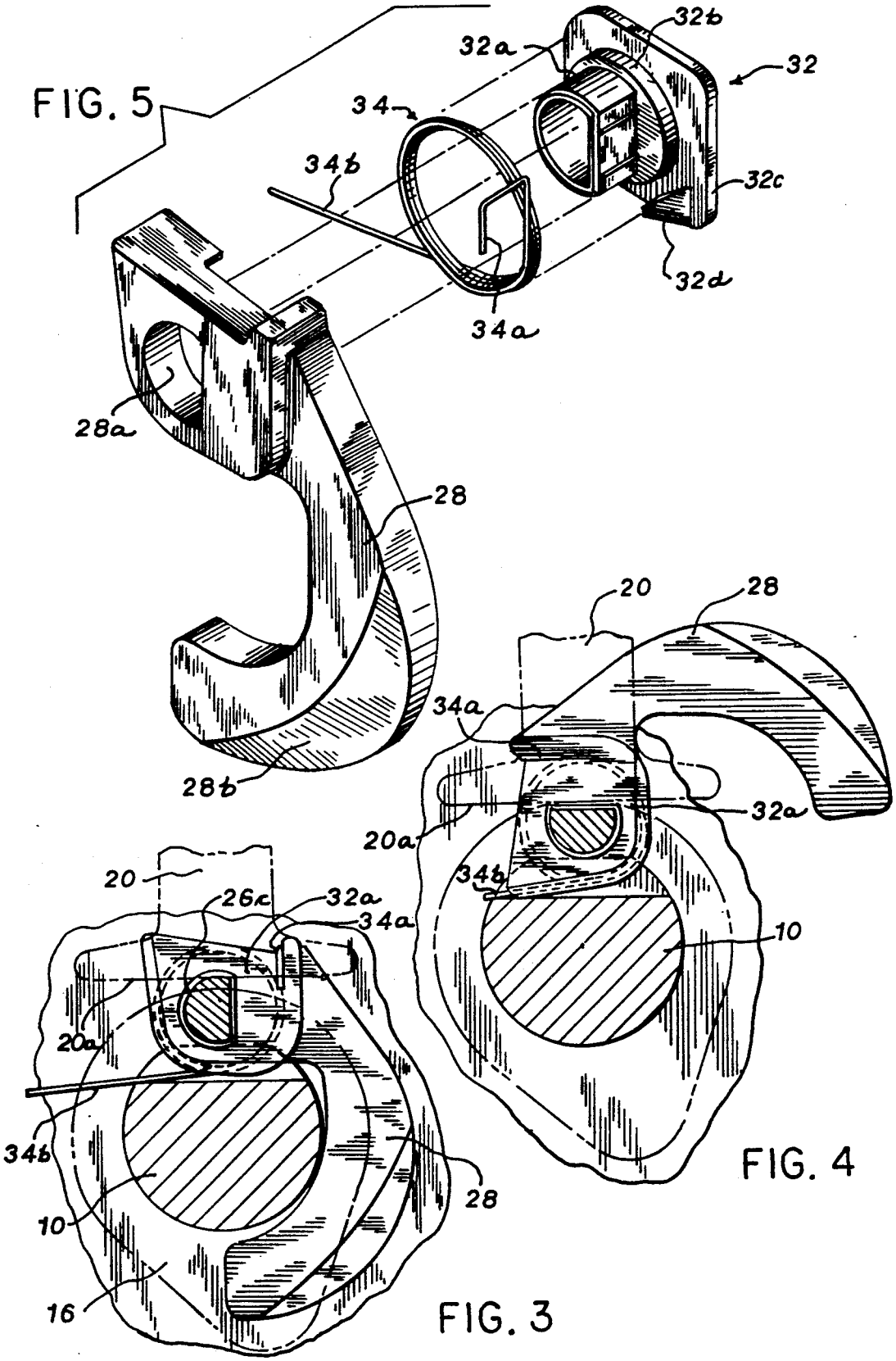
FIG. 3 is an end view of the compression release-cam shaft assembly of FIG. 1 at engine starting speeds with the valve being in the open position.
FIG. 4 is an end view of the compression release-cam shaft assembly of FIG. 1 at engine running speeds with the valve being in the closed position.
FIG. 5 is an exploded view of the flyweight-spring-bushing subassembly.

As best shown in FIGS. 3 and 4, shaft 26 has an opposite end 26*b* that is substantially D-shaped. At engine starting speeds as depicted in FIG. 3, the rounded outer surface portion of shaft end 26*b* engages tappet surface 20*a* of tappet 20, thereby causing the associated valve to open. At engine running speeds as depicted in FIG. 4, flyweight 28 moves radially outward causing shaft 26 to rotate. The rotation of shaft 26 causes the flat outer surface portion of shaft end 26*b* to face tappet surface 20*a*, thereby preventing tappet 20 from being raised. Thus, the compression in the combustion chamber is not relieved at engine running speeds.

Figure 2:
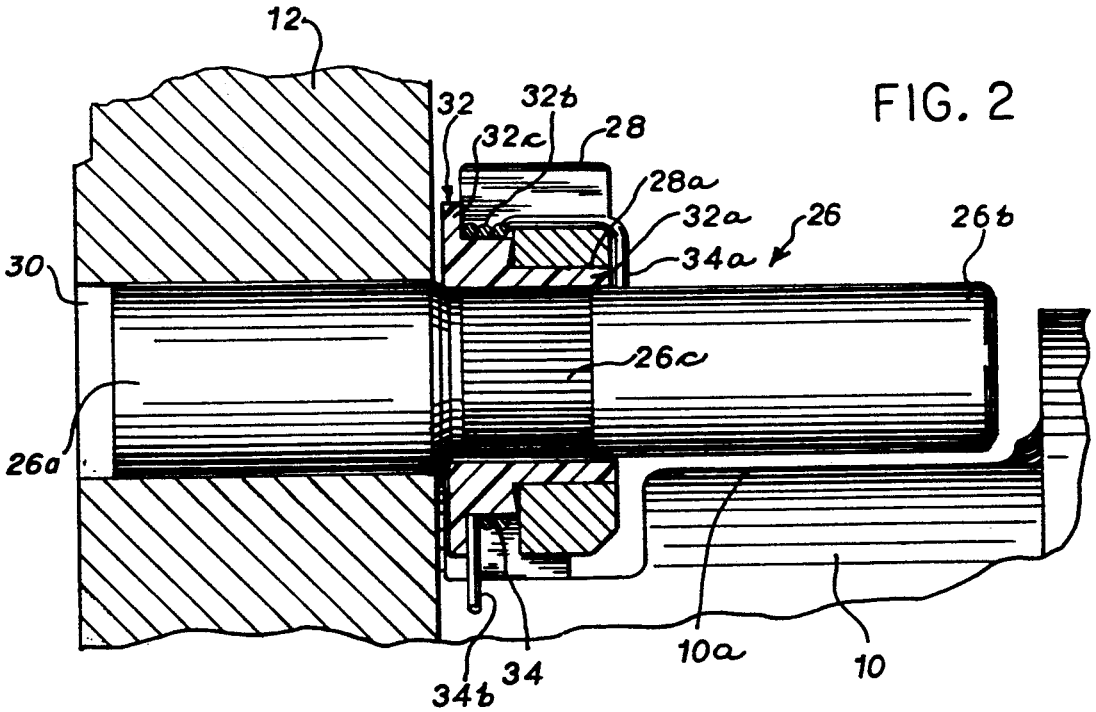
FIG. 2 is a side view of the compression release assembly of FIG. 1, shown in partial section.

Referring to FIGS. 1 and 2, shaft 26 has a knurled section 26*c* that engages a deformable bushing/spring retainer 32. Knurled portion 26*c* is designed to retain bushing 32 in both the axial and radial directions.

Bushing 32 has a sleeve portion 32*a* whose inner surface engages knurled section 26*c*, and whose outer surface engages flyweight 28. Flyweight 28 has an aperture 28*a* therein for receiving sleeve portion 32*a*. Bushing 32 also has a shoulder 32*b* upon which rests several turns of a torsion spring 34. Bushing 32 also has a substantially flat flange portion 32*c* which retains spring 34. Bushing 32 is preferably made from a deformable plastics material such as nylon.

Spring 34 is made from a lightweight, relatively thin wire and has between about 1 to 6 turns, with 2 to 4 turns being optimal. The use of a thin wire enables the compression release mechanism to be more compact. Spring 34 has a first end 34*a* which is bent around flyweight 28 to attach the spring to the flyweight. In the alternative, spring end 34*a* could be attached to a notch in release shaft 26. A second end 34*b* of the spring rests against cam shaft 10.

As best shown in FIG. 2, release shaft 26 is not supported by cam shaft 10, and in particular is not supported by surface 10*a* of the cam shaft. In many prior art devices, a cam shaft surface must be specially machined to be a bearing surface for the compression release shaft. The special machining requires an additional manufacturing step not required by the present invention. In the present invention, the same cutting tool cuts aperture 30 and cam shaft surface 10*a* in a single step. An additional finishing step is not required for surface 10*a*.

FIG. 3 is a cross-sectional end view of the assembly of FIG. 1, taken along line 3—3 of FIG. 1. FIG. 3 more clearly depicts the orientations of cam shaft 10, flyweight 28, compression release shaft end 26*b*, tappet 20, and spring 34 when the engine is at starting speeds. FIG. 3 depicts tappet 20 being raised by the rounded outer surface portion of shaft end 26b. FIG. 4 is similar to FIG. 3 except FIG. 4 depicts the compression release mechanism at engine running speeds, wherein the flat outer surface portion of shaft end 26b faces tappet surface 20a.

FIG. 5 is an exploded view of the compression release mechanism according to the present invention. As depicted in FIG. 5, bushing 32 includes a notch or step 32d near the perimeter of flange 32c. End portion 34b of spring 34 is placed on step 32d and is retained thereon when the compression release mechanism is assembled onto the cam shaft assembly. When spring end portion 34b rests on step 32d, the spring end portion does not interfere with cam shaft 10 during the assembly process. Without step 32d, end portion 34b would have to be manually held while the subassembly is being assembled onto the cam shaft, increasing the difficulty and decreasing the speed of the assembly process.

As also shown in FIG. 5, sleeve portion 32a of bushing 32 and flyweight aperture 28a are preferably D-shaped. Thus, the knurled section 26c of release shaft 26 is also D-shaped since it is received in sleeve 32a. By making shaft section 26c, sleeve 32a, and flyweight aperture 28a D-shaped, positive positioning is achieved between these component parts without the need for any assembly step to align these components. This positive positioning, along with the use of knurled section 26c and nibs 32a'' (FIG. 12), eliminates the need for pins, fasteners, welds, and other connectors to keep the components together. The cost and complexity of the assembly is thereby decreased.

As shown in FIGS. 5 and 7, flyweight 28 has a scalloped surface 28b to avoid interference between the flyweight and the inner wall of the engine housing (not shown) when the flyweight is in its radially-outward position.

FIGS. 6 and 7 are end views of the flyweight-spring-bushing subassembly, depicting opposite ends of the subassembly. As shown in FIGS. 6 and 7, bushing flange 32c is not completely symmetrical since flange portion 32c' extends further radially outward than for example flange portion 32c'' to insure that spring 34 is totally captured by the flange. FIGS. 6 and 7 also depict spring end portion 34b resting on step 32d to facilitate assembly of the subassembly onto the cam shaft.

As best shown in FIG. 6, flyweight 28 also has a chamfered surface 28c to avoid interference with the cam shaft at engine starting speeds. Flyweight 28 is preferably made of a powdered metal such as sintered iron, having a material density of about 6.3 grams per cubic centimeter.

FIGS. 8 through 12 depict specific features of the flyweight-spring-bushing subassembly according to the present invention. The top view of FIG. 8 depicts the manner in which spring 34 is both attached to flyweight 28 and captured between the flyweight and flange 32c of bushing 32.

The cross-sectional top view depicted in FIG. 9 also depicts the retaining of spring 34 by shoulder 32b and by flange 32c without the need for any pins or fasteners as in prior art devices.

FIG. 10 is a cross-sectional view of the subassembly, taken along line 10—10 of FIG. 6. Since flange 32c actually engages flyweight 28 as shown in FIG. 10, spring 34 is totally captured between these members.

FIG. 11 is a cross-sectional view of flyweight 28, taken along line 11—11 of FIG. 7. As shown in FIG. 11, chamfered surface 28c prevents interference with cam shaft 10 at cam shaft section 10a. The shape of scallop 28b is also depicted in FIG. 11.

FIG. 12 is a cross-sectional view depicting the interface between sleeve portion 32a of bushing 32 and flyweight 28. As depicted in FIG. 12, the outer surface 32a' of sleeve portion 32a has a protrusion or nib 32a'' extending therefrom which engages flyweight surface 28a' to provide an interference fit between sleeve surface 32a' and flyweight surface 28a'. In a preferred embodiment, four or more protrusions 32a'' are used.

FIGS. 13a through 14b depict the steps in assembling the flyweight-spring-bushing subassembly onto the cam shaft assembly. The first assembly step, as depicted in FIG. 5, is to assemble the subassembly consisting of flyweight 28, spring 34, and bushing 32. The spring is placed on the bushing, and then sleeve portion 32a is press-fit into flyweight aperture 28a. Spring end 34a is hooked on the flyweight. Spring end portion 34b is placed in step 32d as discussed above.

Figure 13A:
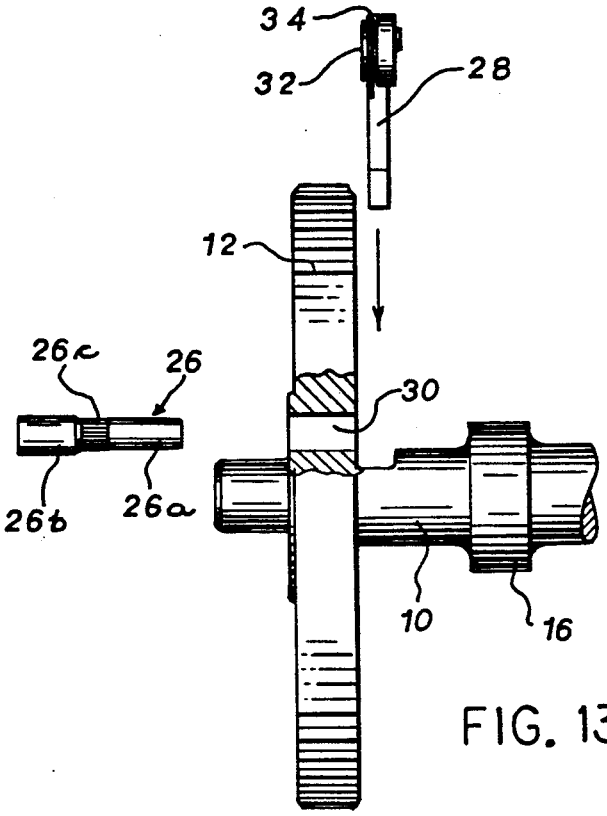
Figure 13B:
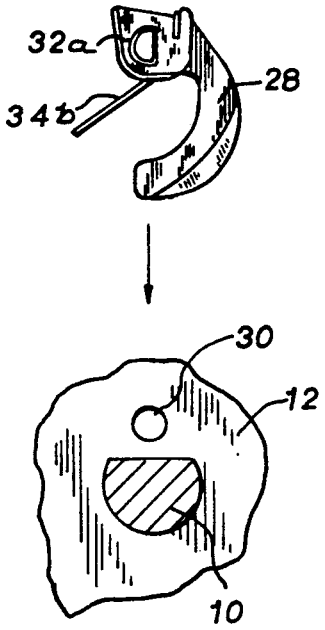
FIG. 13*b* is an end view of the step depicted in FIG. 13*a*.
Figure 14A:
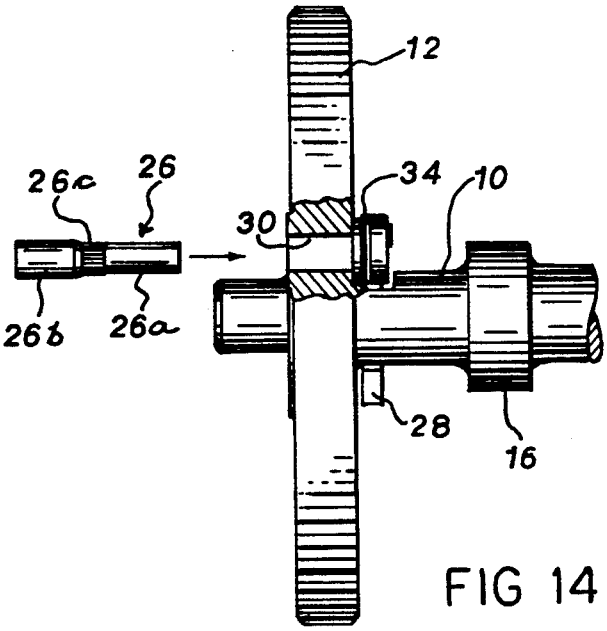
FIG. 14*a* is a side view of a subsequent assembly step wherein the compression release shaft is connected to the flyweight-spring-bushing subassembly.
Figure 14B:
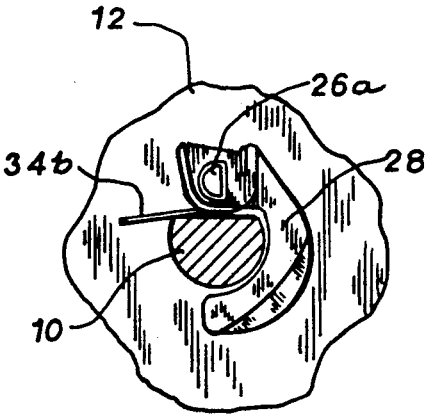

As shown in FIGS. 13a and 13b, the flyweight-spring-bushing subassembly is then moved into position so that sleeve portion 32a is aligned with one side of cam gear aperture 30. FIG. 13a is a side view of this alignment step, with FIG. 13b being an end view thereof.

Once the flyweight-spring-bushing subassembly has been properly aligned with one side of cam gear aperture 30, compression release shaft 26 is inserted through the opposite side of aperture 30 and into sleeve portion 32a. See FIGS. 14a and 14b. Knurled section 26c of release shaft 26 is press-fit into sleeve portion 32a. End portion 34b of spring 34 is positioned so that it rests against cam shaft 10.

While a preferred embodiment of the present invention has been shown and described, alternate embodiments will be apparent to those skilled in the art and are within the intended scope of the present invention. Therefore, the scope of the present invention is to be limited only by the following claims.

We claim:

1. A compression release assembly that relieves pressure in an engine combustion chamber during engine starting, comprising:

a compression release shaft;

a centrifugally-responsive flyweight having an aperture therein that receives a portion of said compression release shaft;

a torsional spring; and a spring retainer adapted to being received within said flyweight aperture and having a flange, said spring being retained between retaining surfaces of said spring retainer and said flyweight.

2. The compression release assembly of claim 1, wherein said compression release shaft has an end that is substantially D-shaped in cross-section.

3. The compression release assembly of claim 1, wherein said flyweight aperture is substantially D-shaped, and wherein said portion of said compression release shaft is also substantially D-shaped.

4. The compression release assembly of claim 1, wherein said spring has a bent first end that is interconnected with said flyweight.

5. The compression release assembly of claim 1, wherein said spring has an end that is held by said spring retainer during an assembly step of said compression release assembly.

6. The compression release assembly of claim 1, wherein said spring has 1 to 6 turns.

7. The compression release assembly of claim 1, wherein said spring retainer includes a bushing portion that receives said portion of said compression release shaft.

8. The compression release assembly of claim 7, wherein said compression release shaft portion has a knurled outer surface that engages said bushing portion.

9. The compression release assembly of claim 7, wherein said bushing portion is substantially D-shaped.

10. The compression release assembly of claim 1, wherein said spring retainer flange includes a step that retains a portion of said spring during an assembly step.

11. The compression release member of claim 1, wherein said spring retainer is made from a plastics material.

12. A compression release mechanism that engages a valve operating device to operate a valve on an engine combustion chamber, said valve operating device including a cam gear, a can shaft rotatable with said cam gear, and a cam follower interconnected with said valve, said compression release mechanism comprising:

a rotatable compression release shaft having a first end disposed within an aperture in said cam gear and having an opposite second end that engages said cam follower at engine starting speeds;

a centrifugally-responsive flyweight having an inner surface that defines an aperture in said flyweight;

a torsional spring; and a bushing having a first portion that is disposed between said compression release shaft and said flyweight inner surface, and having a second portion, said spring being retained between retaining surfaces of said second portion and said flyweight.

13. The compression release mechanism of claim 12, wherein said second end of said compression release shaft is substantially D-shaped.

14. The compression release mechanism of claim 12, wherein said second end of said compression release shaft does not contact said cam shaft when said second end engages said cam follower.

15. The compression release mechanism of claim 12, wherein said compression release shaft has a partially knurled surface on which said first bushing portion is disposed.

16. The compression release mechanism of claim 12, wherein said flyweight aperture is substantially D-shaped.

17. The compression release mechanism of claim 2, wherein said spring has between 2 to 4 turns inclusive.

18. The compression release mechanism of claim 12, wherein said first bushing portion is a sleeve that receives said compression release shaft.

19. The compression release mechanism of claim 18, wherein said sleeve and said flyweight aperture are substantially D-shaped.

20. The compression release mechanism of claim 12, wherein said second bushing portion includes a flange.

21. The compression release mechanism of claim 12, wherein said second bushing portion includes a step that retains said spring.

22. The compression release member of claim 12, wherein said bushing is made from a deformable plastics material.

23. A method of assembling a compression release mechanism to an engine valve operation system, said valve operating system including a cam shaft and a cam gear having an aperture therein, said method comprising:

attaching a torsion spring to a centrifugally-responsive flyweight, said flyweight having an aperture therein;

inserting a sleeve portion of a bushing into said flyweight aperture, said bushing having a flange portion, said bushing also retaining said spring between said flange portion and said flyweight;

aligning said flyweight aperture containing said sleeve portion with a first side of said cam gear aperture; and inserting a compression release shaft through an opposite second side of said cam gear aperture and into said sleeve portion of said bushing.

24. The method of claim 23, further comprising:

placing a section of said spring on a step on said flange portion before said flyweight aperture is aligned with said cam gear aperture.

25. The method of claim 23, wherein said flyweight aperture and said sleeve portion are substantially D-shaped.

26. The method of claim 23, wherein said spring retaining step is achieved without the use of a fastener.

27. The method of claim 23, wherein said shaft inserting step further comprising:

locking said compression release shaft inside said sleeve portion by press-fitting a knurled section of said shaft inside said sleeve portion.

28. The method of claim 23, wherein said sleeve portion inserting step further comprises:

press-fitting said sleeve portion into said flyweight aperture.

29. The method of claim 28, wherein said sleeve portion has an outer surface that has a plurality of protrusions extending therefrom, said protrusions engaging said flyweight during said press-fitting step.

* * * * *

UNITED STATES PATENT AND TRADEMARK OFFICE

CERTIFICATE OF CORRECTION

PATENT NO. : 5,197,422

DATED : March 30, 1993

INVENTOR(S) : Oleksy et al

It is certified that error appears in the above-identified patent and that said Letters Patent is hereby corrected as shown below:

CLAIM 12, Col. 7, Line 19, delete "can" and substitute therefor ----cam----

Signed and Sealed this

Eighth Day of February, 1994

Bruce Lehman

*Attest:*

BRUCE LEHMAN

*Attesting Officer*

*Commissioner of Patents and Trademarks*